United States Patent [19]

Delaney

[11] Patent Number: 4,827,575

[45] Date of Patent: May 9, 1989

[54] SET OF GEM-LIKE JACKS

[76] Inventor: George Delaney, 6956 Hawthorne La., Hanover Park, Ill. 60103

[21] Appl. No.: 181,060

[22] Filed: Apr. 13, 1988

[51] Int. Cl.[4] ..... A44B 21/00

[52] U.S. Cl. ..... 63/3; 63/2; 63/29.1; 63/Dig. 3; 24/3A; 24/3B; 273/1GG; 273/148R

[58] Field of Search ..... 63/1.1, 2, 3, 20, 21, 63/23, 29.1, DIG. 3; 273/1 GG, 1 G; 24/3; 446/26, 27, 105

[56] References Cited

U.S. PATENT DOCUMENTS

| | | | |
|---|---|---|---|
| 2,568,212 | 7/1951 | Backman | 63/DIG. 3 X |
| 3,323,325 | 6/1967 | Meyer | 63/4 |
| 4,309,879 | 1/1982 | Gretz et al. | 63/29.1 |

FOREIGN PATENT DOCUMENTS

| | | | |
|---|---|---|---|
| 560252 | 9/1957 | Belgium | 63/4 |
| 412711 | 4/1925 | Fed. Rep. of Germany | 63/29.1 |
| 729828 | 12/1966 | Italy | 63/2 |

OTHER PUBLICATIONS

Times Herald "Bathtub Stoppers, Safety Pins Are Made into Modern Jewelry" Oct. 3, 1946, p. 25.

*Primary Examiner*—Kenneth J. Dorner
*Assistant Examiner*—Laurie K. Cranmer
*Attorney, Agent, or Firm*—Michael Ebert

[57] ABSTRACT

A set of gem-like jacks for playing the game of jacks, the jacks being adapted to form in combination with a band of resilient material having a row of holes therein a bracelet or other article of jewelry. Each jack is molded of transparent plastic material to form an opposing pair of four-sided pyramids having triangular sides and a common square base, the peaks of the pyramids and the diagonal corners of the base having small balls integral therewith to satisfy the functional requirements of a playing jack. Because of internal reflections from the triangular sides of the jack and its external geometric form, the jack simulates the optical properties of a multi-faceted gem. To form an article of jewelry, jacks are combined with the band by snapping a ball of a jack into a band hole, the hole dilating to admit the ball and then resuming its normal diameter to trap the ball and thereby retain the jack on the band.

9 Claims, 1 Drawing Sheet

Fig. 1.
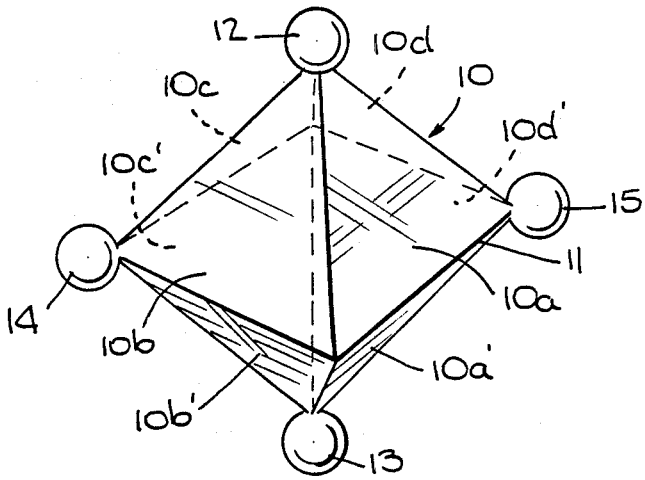
Fig. 2.
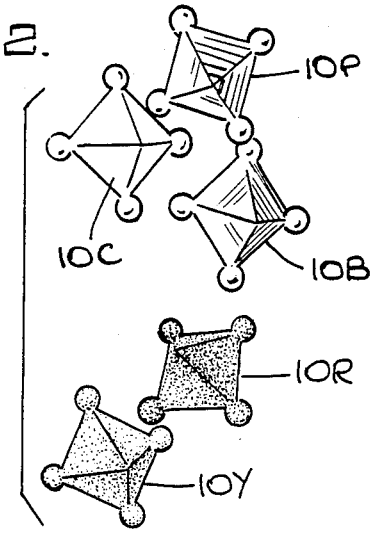
Fig. 3.
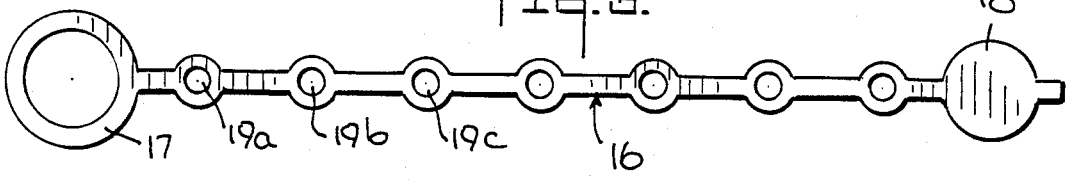
Fig. 6.
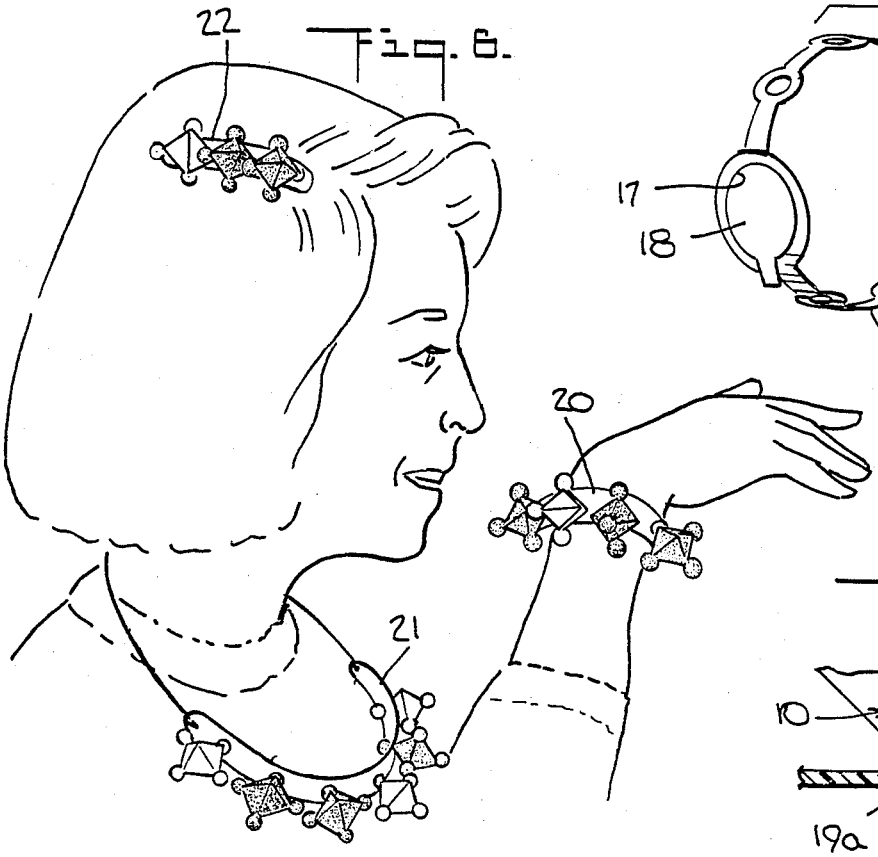
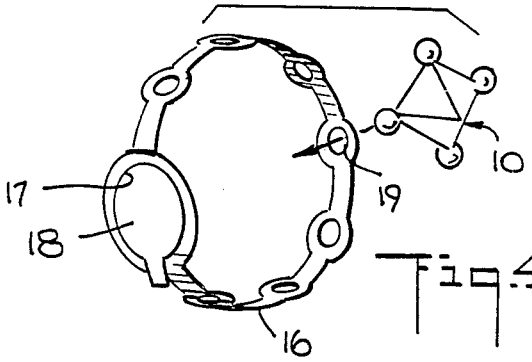
Fig. 4.
Fig. 5.
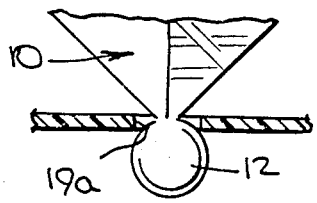

SET OF GEM-LIKE JACKS

BACKGROUND OF INVENTION

1. Field of Invention:

This invention relates generally to pieces for playing the game of jacks, and more particularly to jacks which simulate gems and are readily attachable to a band of resilient material to create a bracelet, a necklace or other article of jewelry.

2. Status of Prior Art:

A conventional jack for playing the game of jacks is a small six-pointed object usually of metal, four of the points terminating in ball-like tips. The game of jacks is played with a ball, the players tossing, catching and moving these objects in a variety of figures requiring coordination of the hands and eyes.

The game of jacks has been played by children for at least fifty years, and despite the many new games which in recent years have entered the market, children continue to play this classic game. Perhaps the reason for the continuing popularity of jacks is that it takes perseverance and long practice on the part of a child to acquire the skill necessary to defeat an opposing player. Hence, unlike most other games which are quickly mastered, the players do not lose interest in the game and seek to perfect their skill.

The typical young girl who takes delight in playing jacks is also at a stage of development where she takes pleasure in personal adornment. Thus, she likes to wear jewelry appropriate to her age, such as a barrette in the form of a decorative bar to clip her hair in place, a bracelet to be worn on the wrist, or a necklace that encircles the neck.

Children are fascinated by gems, for they see these worn by adults and therefore wish to adorn themselves in a similar fashion. But precious gems are very costly and are inappropriate to children. Transparent gemstones, such as emeralds, rubies and sapphires are usually cut into prism-like or faceted configurations to exploit repeated internal light reflections. These create a sparkling, brilliant effect and color amplification (see Beesley U.S. Pat. No. 4,534,644). Faceted gems are often cut in a "brilliant" style, which is basically composed of triangular facets. Light rays which enter the gem through one facet thereof then strike an inclined triangular facet on the opposite side thereof and are internally reflected thereby.

SUMMARY OF INVENTION

In view of the foregoing, the main object of this invention is to provide a set of jacks for playing the game of jacks, the jacks in the set having gem-like characteristics simulating a variety of differently colored gemstones. Thus, the rocks in the set may have the colors of garnet, sapphire and emerald, as well as relatively colorless diamonds.

A significant advantage of the invention is that the player of jacks is now able to play this game with gem-like pieces, thereby enhancing the play experience; for as the jacks are tossed or otherwise manipulated, enjoyable optical effects are produced.

More particularly, an object of this invention is to provide in combination with a set of jacks for playing the game of jacks, a strip or band of resilient material to which the jacks may readily be attached to create an article of jewelry which reflects the taste of the creator. Thus, the article may take the form of a bracelet composed of a row of diamond-like, colorless jacks or jacks which differ in color and simulate diverse precious gems.

Also an object of this invention is to provide a set of jacks and a matrix therefor to create an article of jewelry therefor to create an article of jewelry which may be mass produced at low cost.

Briefly stated, these objects are attained in a set of gem-like jacks for playing the game of jacks, the jacks being adapted to form in combination with a band of resilient material having a row of holes therein a bracelet or other article of jewelry. Each jack is molded of transparent plastic material to form an opposing pair of four-sided pyramids having triangular sides and a common square base, the peaks of the pyramids and the diagonal corners of the base having small balls integral therewith to satisfy the functional requirements of a playing jack. Because of internal reflections from the triangular sides of the jack and its external geometric form, the jack simulates the optical properties of a multi-faceted gem. To form an article of jewelry, jacks are combined with the band by snapping a ball of a jack into a band hole, the hole dilating to admit the ball and then resuming its normal diameter to trap the ball and thereby retain the jack on the band.

BRIEF OUTLINE OF DRAWINGS

For a better understanding of the invention as well as other objects and further features thereof, reference is made to the following detailed description to be read in conjunction with the accompanyings drawings, wherein:

FIG. 1 shows, in perspective, a single gem-like play jack in accordance with the invention;

FIG. 2 illustrates a set of gem-like jacks having different colors to simulate different gems;

FIG. 3 shows in top view a jack matrix to create an article of jewelry, the matrix in this instance being in strip or band form to create a jack-ornamented bracelet;

FIG. 4 shows the manner in which the ends of the strip are joined together to form a bracelet, and the manner in which a jack is snapped into a socket hole in the strip;

FIG. 5 illustrates how a jack is retained by the strip; and

FIG. 6 shows a girl wearing a barrette in her hair, a bracelet on her wrist and a necklace about her neck, all these articles of jewelry being ornamented by gem-like jacks.

DESCRIPTION OF INVENTION

Referring now to FIG. 1, there is shown a single jack 10 in accordance with the invention which is molded of a transparent, synthetic plastic material having good optical properties such as polyvinyl chloride, styrene or acrylic resin. Polymethacrylate (Lucite) is a preferred material, for it is characterized by transmission of white light in excess of 90 percent and an index of refraction of 1.49, as well as good dimensional stability and tensile strength.

Jack 10 is constituted by a pair of opposed four-sided pyramids, each having equilateral triangular sides. The upper pyramid has sides 10*a* to 10*d*, and the lower pyramid has sides 10*a'* to 10*d'*. Common to both pyramids is a square base 11. The peaks of the pyramids terminate in small balls 12 and 13 which are integral therewith. Small balls 14 and 15 are integral with the diagonal corners of square base 11. In practice, each side of the square base may be one-half inch in size.

Thus, the duplex pyramidical geometry of jack 10, because of the four balls 12 to 15, has the play characteristics required of a conventional jack. However, because of its geometry and optical properties, jack 10 also has the ornamental characteristics and brilliance of a multi-faceted gem in which multiple internal reflections are produced by the triangular sides.

To simulate sparkling gems, the plastic from which the jacks are made have different colors imparted thereto by suitable pigments or dyes. Thus, a set of jacks, of which only five are shown in FIG. 2, may include a yellow hued jack 10Y, a red hued jack 10R, a blue hued jack 10B, a pink hued jack 10P, and a clear, diamond-like jack 10C. As pointed out in the above-noted Beesley patent, real gems have a color content which may be identified in terms of three basic variables: hue, tone and intensity. Thus, all sapphires are blue, but they differ in grade in terms of the shading and intensity of blue. One may therefore provide some jacks in light blue and others in darker blue. One has available for the purpose of imparting colors to the jacks the full range of colors found in known types of precious gems.

In order to provide a matrix for creating an article of jewelry in which the jacks function as simulated gems, FIG. 3 shows one such matrix in the form of a band or strip 16 of resilient plastic material, such as PVC. One end of the strip terminates in a loop 17, while the other end terminates in a disc 18 whose diameter is slightly larger than the internal diameter of the loop to form therewith a clasp. Hence, by squeezing disc 18 into loop 17, as shown in FIG. 4, one then creates a bracelet to encircle the wrist.

Strip 16 is provided along its length with equi-spaced circular sockets 19*a*, 19*b*, 19*c*, etc., each having a hole therein whose diameter is slightly smaller than the diameter of balls 12 to 15 on the jack. Hence, one can snap, say, ball 12 of the jack into hole 19*a*, as shown in FIG. 5, for the ball when forced through the hole acts to dilate it, the hole then resuming its normal diameter to trap the ball and thereby retain the jack on the strip.

The matrix may take various forms, as illustrated in FIG. 5, to create a jack-ornamented bracelet 20 worn on the wrist of the wearer, a jack-ornamented barrette 22 clipped to the hair, or a jack-ornamented necklace 21 worn about the neck. In the case of the necklace, a string is attached to the ends of a jack-ornamented strip.

One may also provide jack-ornamented brooches or other articles of jewelry. It is not essential for this purpose that the holes to receive the jacks be equi-spaced, for they may be formed into other patterns.

Thus, the user of a set of jacks in accordance with the invention may play a game of jacks with these simulated gems, and also create articles of jack-ornamented jewelry and thereby practice a craft. If one wishes to retain the jacks on a matrix and not to play with the jacks again, all balls on the jacks other than the retaining ball may be snipped off with a wire cutter, so that the origin of the jewelry is then concealed.

While there has been shown and described a preferred embodiment of a set of gem-like jacks in accordance with the invention, it will be appreciated that many changes and modifications may be made therein without, however, departing from the essential spirit thereof. Thus, one may incorporate in the plastic from which the jacks are formed, silica or other reflective powders to enhance the brilliance or sparkle of the gem-like jacks.

I claim:

1. A set of gem-like jacks for playing the game of jacks, each jack being molded of transparent plastic material to form a solid light-transmitting body of a single material having a geometry constituted by an opposing pair of four-sided pyramids having triangular sides and a common square base, the peaks of the pyramids and the diagonal corners of the base having small balls integral therewith and projecting therefrom to satisfy the functional requirements for playing the game of jacks, each jack, because of its geometry and multiple internal reflections from its triangular sides, simulating the optical properties of a multi-faceted gem.

2. A set of jacks as set forth in claim 1, wherein said jacks are formed of acrylic resin.

3. A set of jacks as set forth in claim 2, wherein said triangular sides are equilateral.

4. A set of jacks as set forth in claim 1, in which the jacks are in different colors to simulate a variety of different gems.

5. A set of jacks as set forth in claim 1, wherein each side of the square base has a dimension of about ½ inch.

6. A set of jacks as set forth in claim 1 in combination with a matrix of resilient material having a pattern of socket holes therein, each of which is dimensioned to receive by a snap fit a ball from one of the jacks to create an article of jewelry.

7. The combination as set forth in claim 6, wherein said matrix is a band of resilient material having a row of equi-spaced socket holes therein.

8. The combination as set forth in claim 7, wherein said band has clasp elements at its ends to form a bracelet.

9. The combination as set forth in claim 7, wherein said band has a string attached to its ends to form a necklace.

* * * * *